US005346371A

United States Patent [19]

Bialy et al.

[11] Patent Number: 5,346,371

[45] Date of Patent: Sep. 13, 1994

[54] HYDRAULIC ELEVATOR OIL TANK

[75] Inventors: Louis Bialy, Simsbury; Rajendra V. Mistry, Farmington, both of Conn.

[73] Assignee: Otis Elevator Company, Farmington, Conn.

[21] Appl. No.: 58,826

[22] Filed: May 4, 1993

Related U.S. Application Data

[63] Continuation of Ser. No. 763,389, Sep. 20, 1991, abandoned.

[51] Int. Cl.[5] ..... F04B 39/06

[52] U.S. Cl. ..... 417/312; 220/670

[58] Field of Search ..... 417/312, 313, 360; 220/669, 670, 671, 674

[56] References Cited

U.S. PATENT DOCUMENTS

| | | | |
|---|---|---|---|
| 1,374,905 | 4/1921 | Casey et al. | 220/441 |
| 1,473,595 | 11/1923 | Bingay | 220/671 |
| 1,743,109 | 1/1930 | Borgman et al. | 220/441 |
| 1,748,575 | 2/1930 | Maskrey | 220/442 |
| 1,830,591 | 11/1931 | Clark | 220/441 |
| 2,085,085 | 6/1937 | Dougherty | 220/442 |
| 2,144,945 | 1/1939 | Sutton | 220/442 |
| 2,221,309 | 11/1940 | Gazelle | 220/441 |
| 2,746,892 | 5/1956 | Elfving | 220/442 |
| 3,378,162 | 4/1968 | Smith | 220/442 |
| 3,595,423 | 7/1971 | Yamamoto | 220/441 |
| 3,719,302 | 3/1973 | Hamilton | 220/442 |
| 3,723,027 | 3/1973 | Muntelius | 417/313 |
| 5,084,166 | 1/1992 | Shiraga | 417/312 |

*Primary Examiner*—Richard A. Bertsch
*Assistant Examiner*—Peter Koryinyk
*Attorney, Agent, or Firm*—Lloyd D. Doigan

[57] ABSTRACT

An elevator hydraulic tank is provided with shaped sides which increase the rigidity and heat dissipating ability of the tank. The shaped sides of the tank may be corrugated. A hydraulic machine is mounted on the underside of the tank lid so that maintenance of the machine does not require draining of the tank. The shaped sides are enclosed by an outer shell which further minimizes noise emanating from the tank.

7 Claims, 3 Drawing Sheets

HYDRAULIC ELEVATOR OIL TANK

This application is a file wrapper continuation of prior pending application Ser. No 07/763,389, filed on Sep. 20, 1991, now abandoned.

TECHNICAL FIELD

This invention relates to hydraulic elevators and more particularly to an tank for holding hydraulic fluid.

BACKGROUND ART

Hydraulic elevators utilize a piston assembly to urge a car upwardly in a hoistway. The piston assembly comprises a piston disposed within a cylinder. The piston is urged upwardly by a machine comprising a motor, a motor driven pump, and a valve assembly. To raise the car, fluid is pumped through the valve assembly into the piston assembly, causing the piston to rise. To lower the car, fluid is allowed to flow out of the piston assembly, through the valve assembly, and back to the tank.

Hydraulic machines are submerged in a reservoir or tank containing hydraulic fluid. Tanks are usually rectangularly shaped and are made out of flat sheet steel or the like.

DISCLOSURE OF THE INVENTION

It is an object of the invention to provide a hydraulic elevator tank which minimizes noise emanating therefrom.

It is a further object of the invention to increase the efficiency of a hydraulic elevator by increasing the ability of the tank to reject heat.

It is a further object of the invention to increase the life of the tank.

It is a further object of the invention to minimize maintenance of a hydraulic machine.

According to the invention, an elevator hydraulic tank is provided with shaped sides which increase the strength, rigidity, and heat and noise dissipating ability of the tank. The shaped sides of the tank may be corrugated.

According to a feature of the invention, a hydraulic machine is mounted under a tank lid so that maintenance of the machine does not require draining of the tank.

According to a further aspect of the invention, the shaped sides are enclosed by an outer shell which further minimizes noise emanating from the tank.

The invention solves several problems: the noise emanating from the tank is minimized because the rigidity of the tank minimizes the "drum" effect and because the shaped sides cause sound waves to interfere with each other upon reflection therefrom thereby partially canceling each other out; the improved heat dissipation of the tank, due to the increased surface area thereof, improves the cool down rate of the hydraulic fluid thereby improving the efficiency of the machine; the rigidity of the tank is improved, minimizing fatigue, thereby lengthening the life of the tank; the increased strength of the tank due to its shaped sides allows the tank to be made of a lighter gauge material thereby achieving cost and weight savings and improved heat transfer; and, the machine is less difficult to maintain because the pump and motor are mounted on the tank lid.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1:
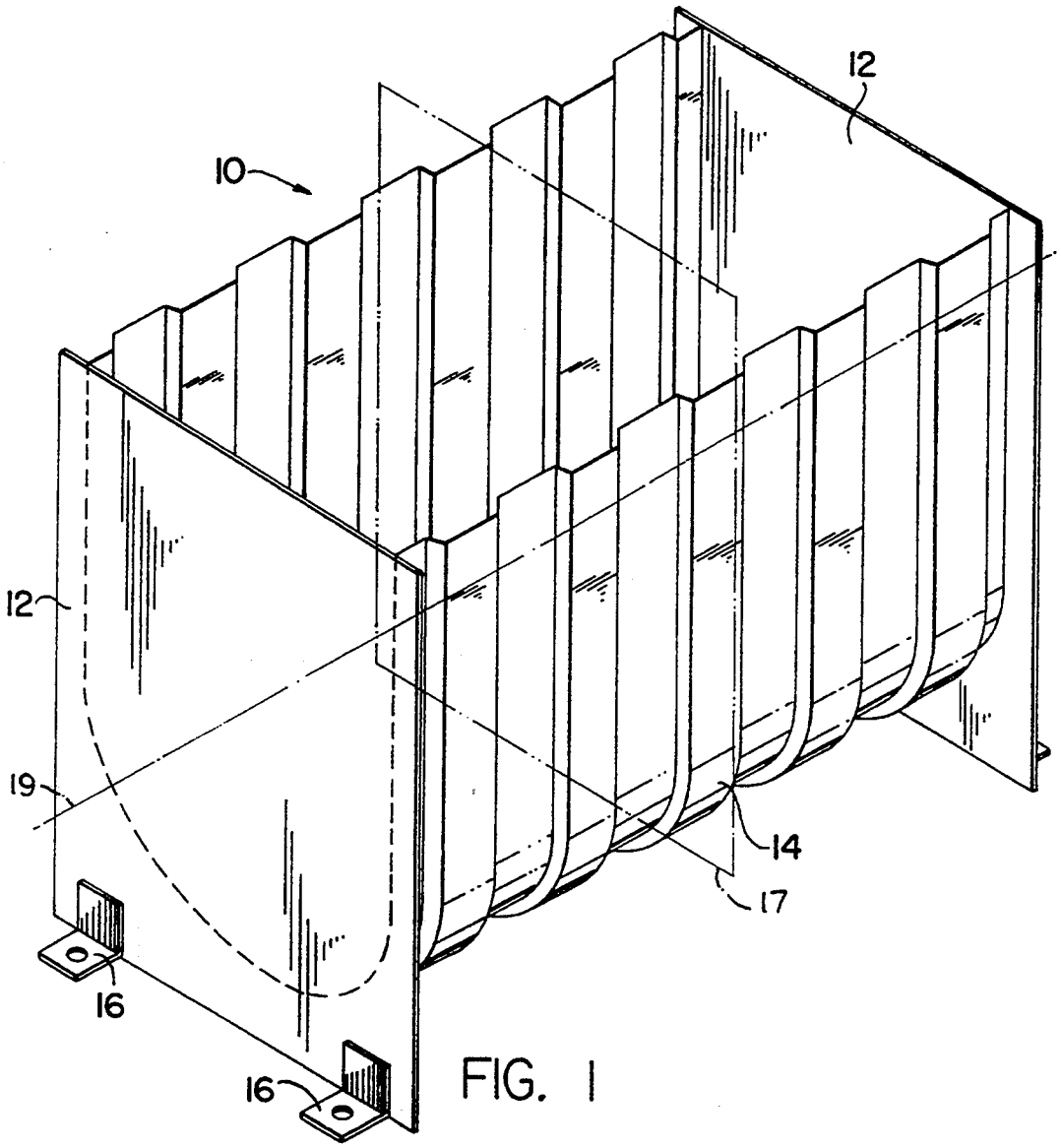
FIG. 1 is a perspective view of an embodiment of an elevator hydraulic oil tank of the invention.

Referring to FIG. 1, a first embodiment of an elevator hydraulic fluid reservoir (tank) 10 is shown. The tank is made of a pair of rectangular end panels 12, which are welded to a continuous panel 14 having a U-shaped cross-section. Each end panel 12 has a pair of tabs 16 welded thereto for mounting the tank to a floor (not shown), as is known in the art. One of ordinary skill in the art will recognize that the tank may be mounted on casters (not shown) for ease of transportation.

Figure 2:
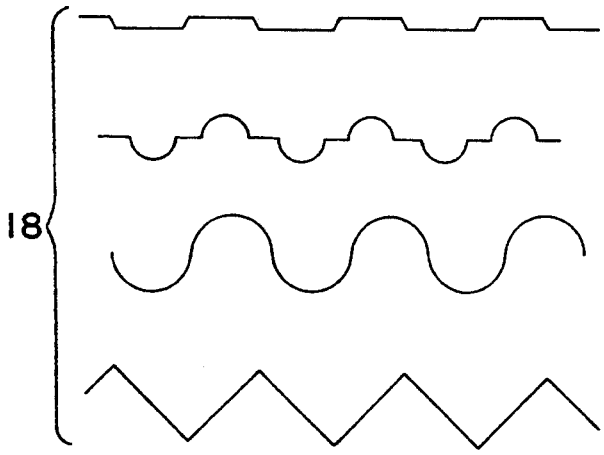
FIG. 2 shows several embodiments of wall shapes of the tank of FIG. 1.

The panel 14 may have a plurality of various shapes 18 as shown in FIG. 2. The shape may be corrugated in parallel ridges or furrows, rectangular, triangular, semicircular, semi-elliptical, or other shape. The corrugations are in disposed in planes 17 (one of which shown) normal to an axis 19 passing through end panels 12. One of ordinary skill in the art will recognize from the teachings herein that the panel may be shaped in other forms to provide extra surface area for heat dissipation, to provide the tank with extra rigidity and strength and to provide a reflective surface for sound so that sound waves may cancel each other out.

Figure 3:
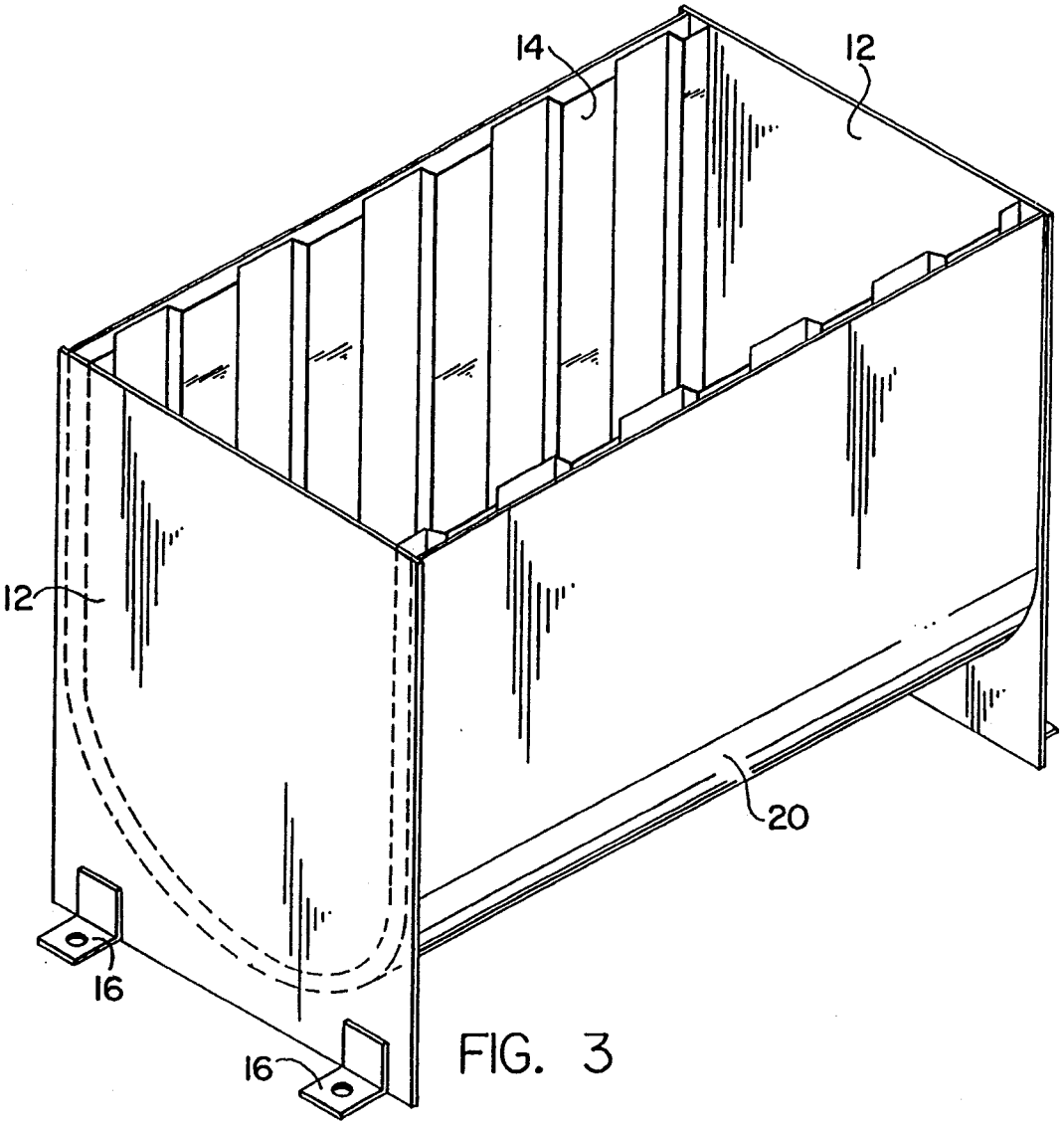
FIG. 3 shows a second embodiment of a corrugated tank of the invention.

As shown in FIG. 3, the panel 18 may be enclosed by an outer jacket 20 of plain sheet steel. The jacket, which is also welded, glued or otherwise attached to each end panel 12, has the same or similar U-shaped cross-section as the panel. The sheet steel helps minimize noise emanating from the tank.

Figure 4:
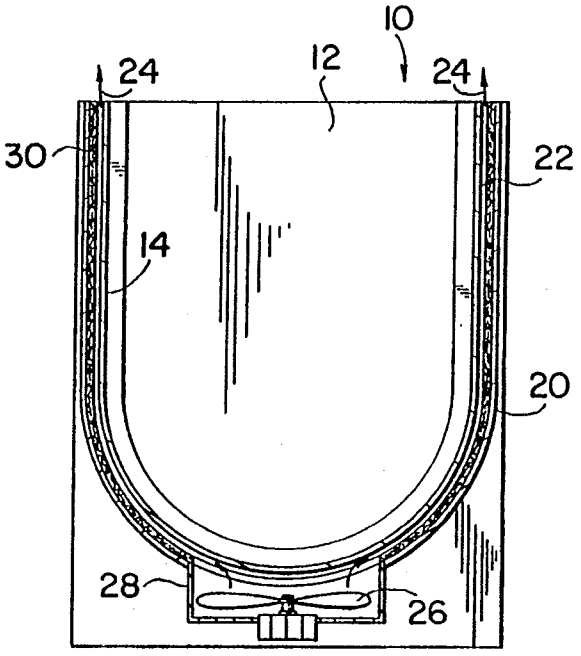
FIG. 4 is a cross-sectional view of the tank of FIG. 3.

Referring to FIG. 4, the space 22 formed between the jacket 20 and the panel 14 is used for circulating cooling media 24, such as air, to increase the heat dissipating ability of the tank. By circulating a cooling media, the probability that the upper operating temperature of hydraulic fluid in the tank 10 is exceeded is minimized. A fan 26 is disposed in a fan housing 28 welded to the bottom part of the jacket. The fan housing is a manifold which extends along a length of the panel 14 and communicates with the outer surface of thereof. The fan is oriented, as will be appreciated by one of ordinary skill in the art, to draw air between the jacket and the panel. The heat dissipating ability of the tank is enhanced thereby.

The space 22 between the jacket and the panel may be completely or partially filled with sound insulation material 30. As one of ordinary skill in the art will recognize the material may be strategically placed within the channels to minimize the vibrational modes and thus reduce noise from the drum effect at specific locations (while maintaining the increased heat dissipating ability of the tank). Further, the end panels 12 of the tank may also have a similar shape as the panel 14 to increase the beneficial effects of the invention.

Figure 5:
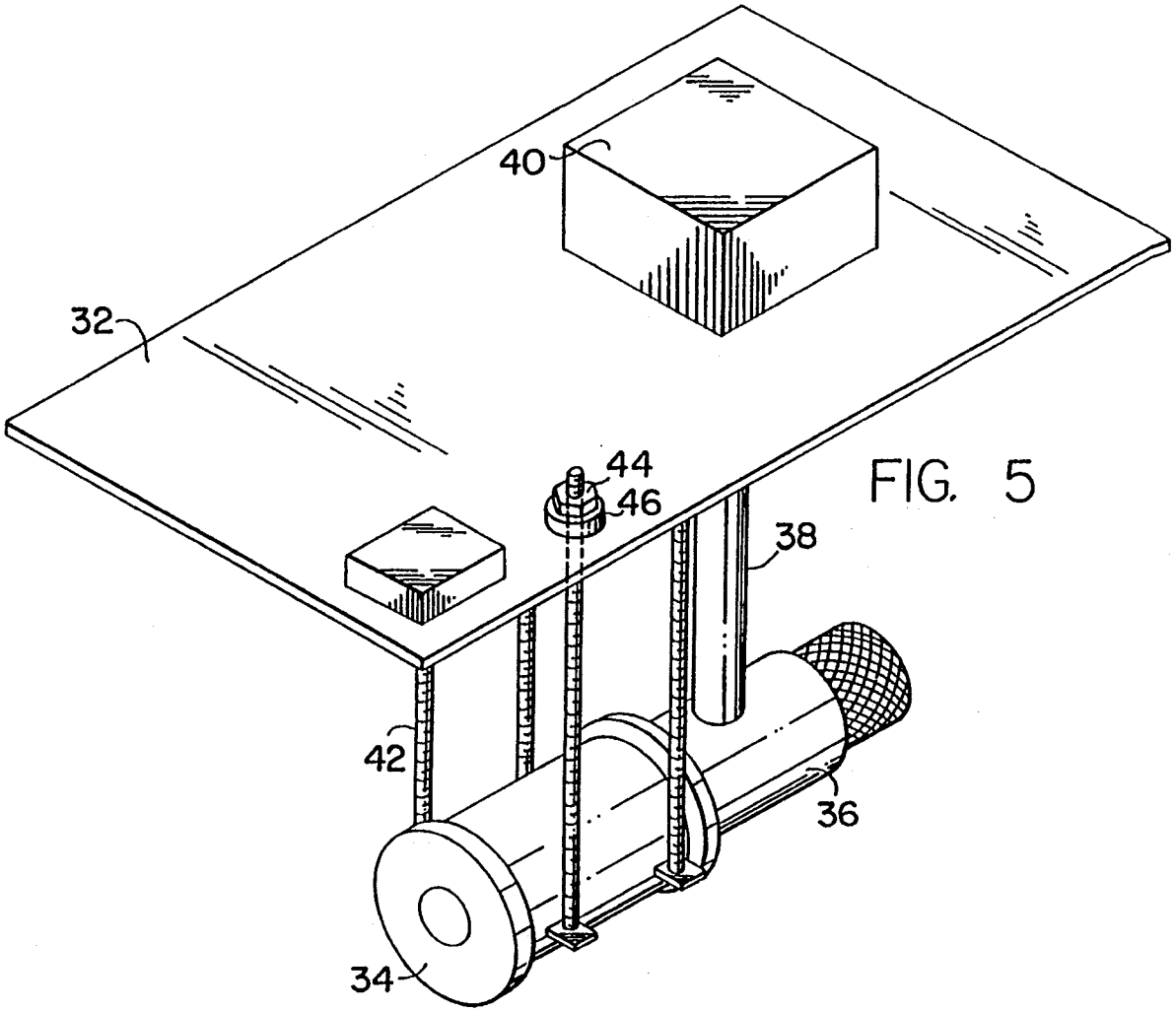
FIG. 5 is a perspective view of a tank cover for use with either of the tanks of FIG. 1 or FIG. 3.

Referring now to FIG. 5, a lid 32 of the tank 10 is shown. A motor 34 is coupled to a pump 36 as is known in the art. Fluid output from the pump flows through pipe 38 to valve assembly 40 which is mounted on the top of the lid. The motor and pump are suspended in the tank by threaded rods 42. The rods are connected to the lid by means of nuts, which screw on the threads, and vibration isolation washers 44 (made of rubber or the like). For ease of illustration only one nut and one washer are shown. The washers minimize vibration experienced by the lid thereby further minimizing the drum effect.

Although the invention has been shown and described with respect to a best mode embodiment thereof, it should be understood by those skilled in the art that the foregoing and various other changes, omissions and additions and the form and detail thereof may be made without departing from the spirit and scope of the invention.

We claim:

1. An elevator tank for holding hydraulic fluid comprising:

a first end panel, a second end panel, an axis extending between said first and second end panels, and a single third panel forming a trough for holding said hydraulic fluid, said third panel having a first end portion attaching to said first end panel, and a second end portion attaching to said second end panel, said third panel having corrugations in planes normal to said axis such that the heat and noise dissipating ability and strength of the tank is enhanced.

2. The tank of claim 1 wherein said corrugations in planes form a plane U-shape.

3. The tank of claim 1 further comprising:

a lid for covering said panel, and means for impelling hydraulic fluid from said tank, said means supported under and attaching to said lid such that said means resides within said hydraulic fluid.

4. The tank of claim 3 wherein said means for impelling further comprises means for minimizing vibration passing to said lid.

5. The tank of claim 1 further comprising:

a jacket disposed around said third panel for muffling sound emanating from said panel, said jacket and said panel not touching.

6. The tank of claim 5 further comprising:

means communicating with said space between said jacket and said panel, said means circulating a cooling media therein.

7. The tank of claim 6 wherein said means comprises:

a manifold attached to said jacket, and a fan disposed with said manifold.

* * * * *